United States Patent [19]

Kaufman et al.

[11] Patent Number: 4,954,751

[45] Date of Patent: Sep. 4, 1990

[54] RADIO FREQUENCY HOLLOW CATHODE

[76] Inventors: Harold R. Kaufman, 925 Columbia, Apt. 622, Fort Collins, Colo. 80525; Raymond S. Robinson, 2612 Bradbury Ct., Fort Collins, Colo. 80521

[21] Appl. No.: 368,872

[22] Filed: Oct. 27, 1988

Related U.S. Application Data

[63] Continuation of Ser. No. 838,765, Mar. 12, 1986, abandoned.

[51] Int. Cl.[5] ..... H01J 7/24

[52] U.S. Cl. ..... 315/111.81; 313/231.31

[58] Field of Search ..... 315/111.41, 111.71, 315/111.81, 111.91; 313/231.31, 302, 360.1, 362.1, 363.1; 250/425, 426

[56] References Cited

U.S. PATENT DOCUMENTS

| | | | |
|---|---|---|---|
| 4,080,549 | 3/1978 | Creedon et al. | 313/302 |
| 4,087,720 | 5/1978 | Takagi | 315/111.91 |
| 4,297,615 | 10/1981 | Goebel et al. | 313/231.31 |
| 4,412,153 | 10/1983 | Kalbfus et al. | 315/111.91 |
| 4,447,732 | 5/1984 | Leung et al. | 315/111.81 |
| 4,543,465 | 9/1985 | Sakudo et al. | 315/111.41 |
| 4,570,106 | 2/1986 | Sohval et al. | 315/111.81 |
| 4,608,513 | 8/1986 | Thompson | 315/111.91 |
| 4,615,588 | 10/1986 | Goldhar | 313/231.31 |
| 4,645,977 | 2/1987 | Kurokawa et al. | 315/111.81 |

*Primary Examiner*—Robert J. Pascal

*Attorney, Agent, or Firm*—Hugh H. Drake

[57] ABSTRACT

A cathode has a pair of cavities in which are disposed respective electrically isolated electrodes. An inert gas is introduced individually into the cavities. Individually outletting from those cavities are a pair of respective apertures. Radio frequency energy is applied to the electrodes to establish a plasma.

12 Claims, 3 Drawing Sheets

RADIO FREQUENCY HOLLOW CATHODE

This application is a continuation of U.S. Pat. Ser. No. 838,765 filed Mar. 12, 1986, abandoned.

This invention relates to electron emissive cathodes. More particularly, it pertains to a hollow cathode which operates in response to radio frequency energy.

Electron emitting cathodes have been used in a variety of devices since the early days of radio tubes and electronic instrumentation. In more recent times, they have found use in connection with the development of ion beams used by rockets employed for space propulsion, as disclosed, for example, in U.S. Pat. No. 3,156,090 -Kaufman, granted Nov. 10, 1964. Such cathodes also have found use in connection with somewhat analogous ion sources employed in connection with industrial applications, as exemplified in U.S. Pat. No. 4,259,145, granted Mar. 31, 1981 to J. M. E. Harper and H. R. Kaufman and in U.S. Pat. No. 4,351,712, granted Sept. 29, 1982 to J. J. Cuomo and J. M. E. Harper.

Two types of electron emitting cathodes have been used frequently in such devices. The simplest is in the form of a refractory metal wire that is electrically heated to electron emitting temperature as disclosed in "Ion Source Design for Industrial Applications" by H. R. Kaufman and R. S. Robinson as published in *AIAA Journal,* volume 20, pp. 745–760 for June of 1982. The other frequently-used type of such a cathode is a more complicated device that requires an internal flow of vapor or gas, usually being called a hollow cathode and representative disclosures of which appear in U.S. Pat. No. 3,515,932 granted on Jun. 2, 1970 to H. J. King as well as U.S. Pat. No. 3,523,210 granted Aug. 4, 1970 to M. P. Ernstene, A. T. Forrester, R. C. Speiser, G. Sohl, A. H. Firestone and P. 0. Johnson.

For a lengthy lifetime of operation, perhaps months or even years as required for space propulsion, hollow cathodes, operated with mercury vapor or a noble gas, have often been preferred. In the case of industrial application, where a much shorter lifetime may be satisfactory, tantalum or tungstun wires, as in the aforementioned in *AIAA Journal* article, often have been preferred.

When used in the presence of reactive gases as in the aforesaid U.S. Pat. Nos. 4,259,145 and 4,351,712, however, the lifetime of a tungsten or tantalum wire cathode tends to be greatly reduced. In general, a hollow cathode will have a longer life lifetime but usually only if an inert gas such as argon is used for the gas flow through the cathode. When a reactive gas is used exclusively, the lifetime of both refractory metal wires and hollow cathodes tend to be reduced to just a few hours or even less.

There are some cathode materials, such as $LaB_6$ that will enable achievement of a reasonable lifetime in the presence of small amounts of oxygen, so that an adequate lifetime may be achieved with some cathodes in some applications. Nevertheless, there are believed to be no cathodes that will exhibit a reasonable lifetime in the presence of a variety of reactive gases in an ion source environment. It is, therefore, one object of the present invention to provide a new and improved cathode that will overcome the presence of the variety of reactive gases in such an environment.

Generally speaking, the prior art is basically limited in performance and life by the use of thermionic emission to generate electrons. Even with the use of a hollow cathode, where the emission may be enhanced by high electric fields at the emissive surface, the temperatures required approximate those for thermionic emission. The high temperatures of thermionic-emission surfaces result in increased chemical reaction rates with reactive gases. In addition, thermionic emitters are sensitive to contamination by reactive materials. It is, therefore, another object of the present invention to provide electron emitting cathodes that obtain extended lifetimes in reactive gas environments.

As indicated, a refractory metal cathode usually is made of tantalum or tungsten wire, and its operation is well understood. When heated to a sufficiently high temperature, approximately 2480 K for tantalum and 2640 K for tungsten, emissions of the order of one amphere per square centimeter can be obtained at the cathode surface. Because the emission varies rapidly with change in emitter temperature, variations of $\pm 100$ K result in wide variations in the quantity of electron emission.

It is customary to use refractory metal cathodes in the shape of long, thin wires, in order to reduce the required heating currents to levels that are easily supplied. As described above, the exposed emitter surface is subject to chemical attack by reactive gases, by reason of its high temperature. Such chemical attack tends to result in the loss of cathode mass due to loss of volatile reaction products. In the event non-volatile products are produced, surface contamination tends to inhibit electron emission. It is, accordingly, a further object of the present invention to provide a new and improved cathode which overcomes or at least minimizes these deficiencies.

Another field of interest is that involving radio frequency diode technology. Analogous to the aforementioned ion sources, operation in connection with a plasma occurs. Reactive gases again frequently are used in a radio frequency diode. Generally because the electron generation does not need to depend on a surface condition of the electrodes, proper operation for a reasonable lifetime is not prevented by the presence of a reactive gas. Also, the operating temperatures of the electrodes involved usually are much less than that of a thermionically emitting cathode, so that reaction rates likewise tend to be less at the electrodes in a radio frequency diode than that which occurs at the surface of a cathode. Consequently, still another object of the present invention is to provide a new and improved hollow cathode which takes advantage of certain of the characteristics and parameters present in the technology heretofore applicable to radio frequency diodes.

A hollow cathode constructed in accordance with the present invention includes a housing assembly within which is disposed a pair of electrodes that are mutually spaced apart and electrically isolated. An electrically balanced radio frequency discharge between the electrodes creates a discharge plasma that exhibits plasma sheaths immediately adjacent to corresponding different ones of the electrodes beyond which sheaths the radio frequency voltages within the plasma, relative to the assembly, are substantially smaller than those within the sheaths.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements and in which:

Figure 2:
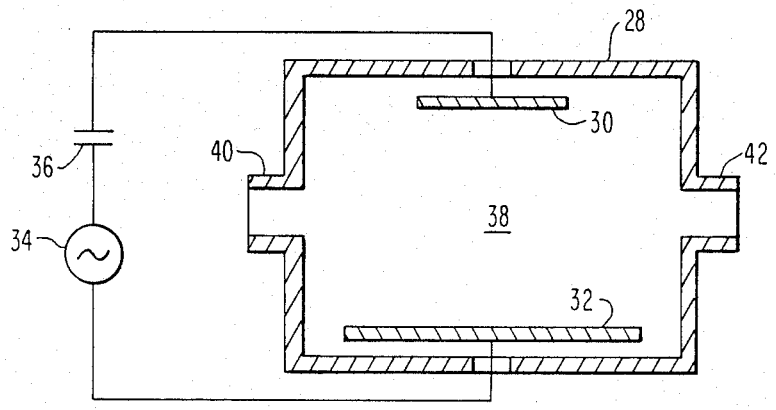
FIG. 2 is a cross-sectional diagram of a radio frequency diode, useful in further explanation of the apparatus depicted in later ones of the figures.
Figure 2A:
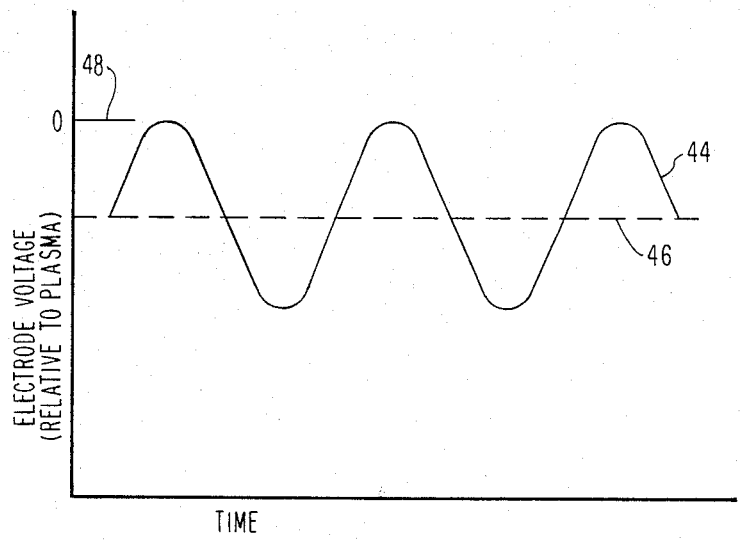
Figure 3:
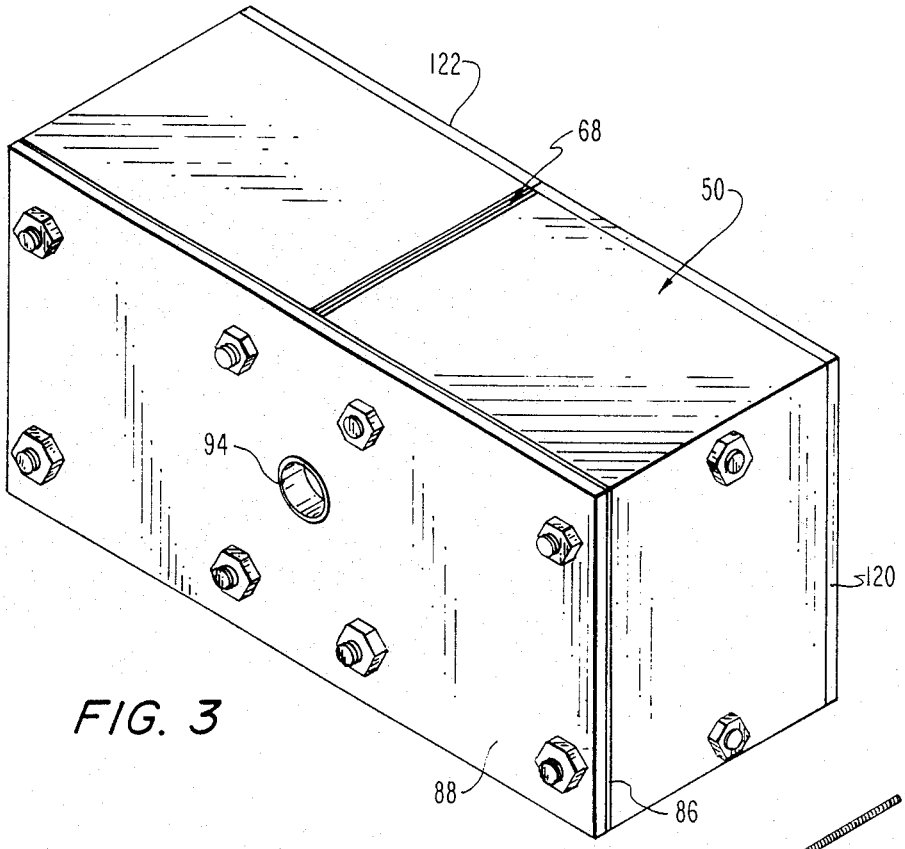
Figure 4:
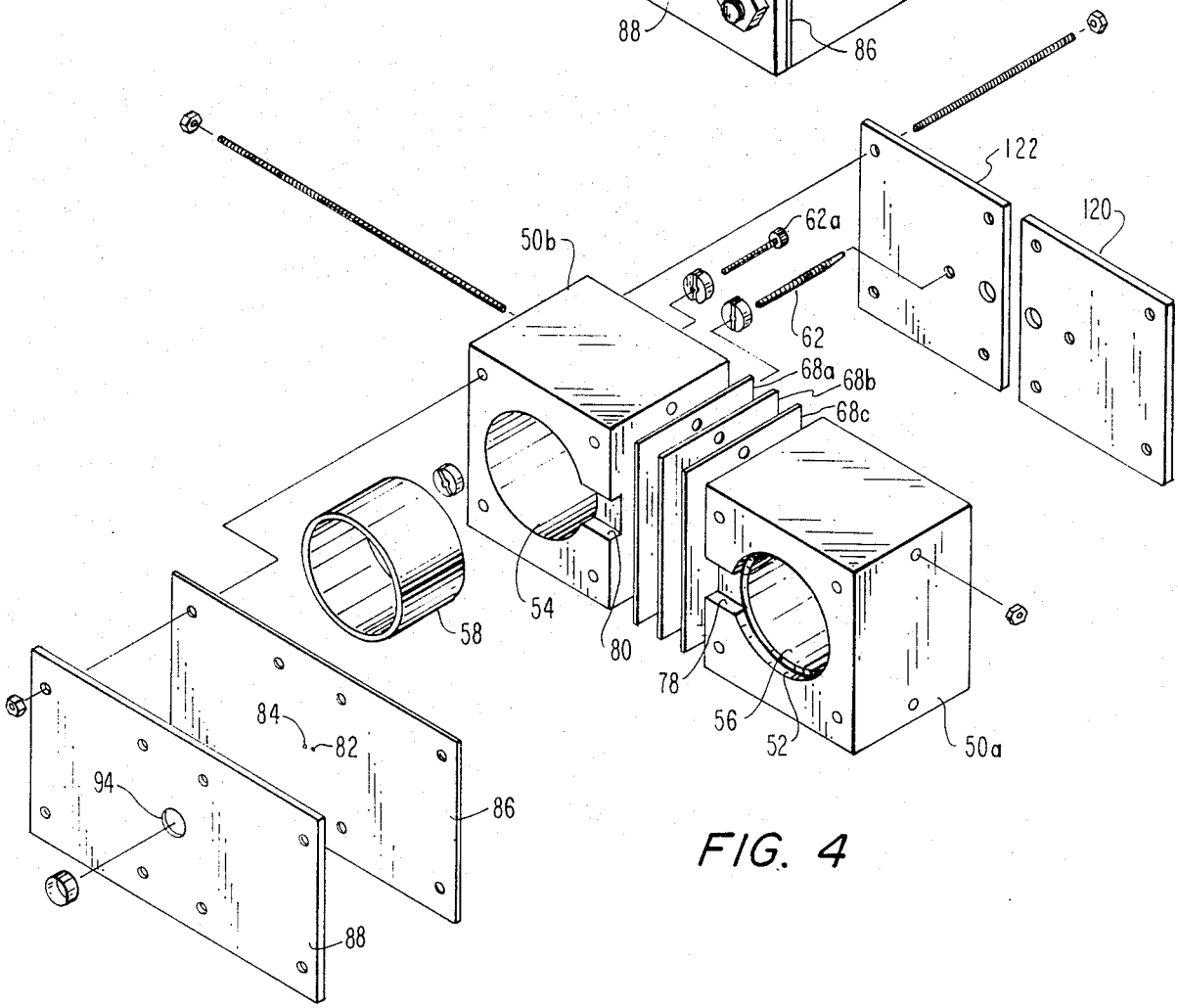
Figure 5:
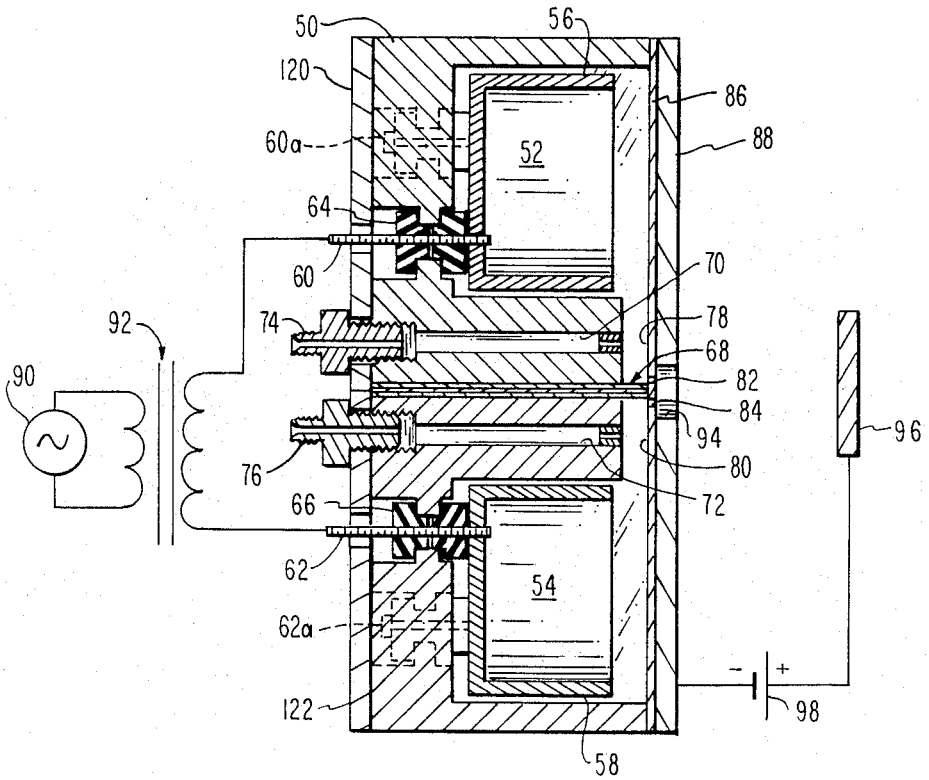
Figure 6:
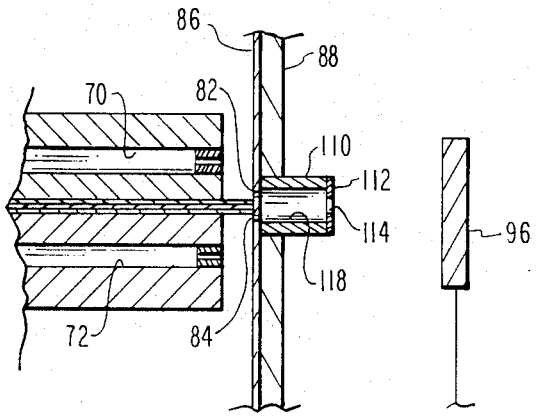

FIG. 2*a* is a graphical representation of operation of apparatus like that shown in FIG. 2;

FIG. 3 is an isometric view of an apparatus constructed in accordance with the present invention;

FIG. 4 is an exploded isometric view of the apparatus shown in FIG. 3, although redundancy of some like parts have not been shown for clarity;

FIG. 5 is a partially cross-sectional and partially schematic view of the apparatus shown in FIGS. 3 and 4; and FIG. 6 illustrates an alternative modification for a portion of that which is described with respect to FIG. 5.

Figure 1:
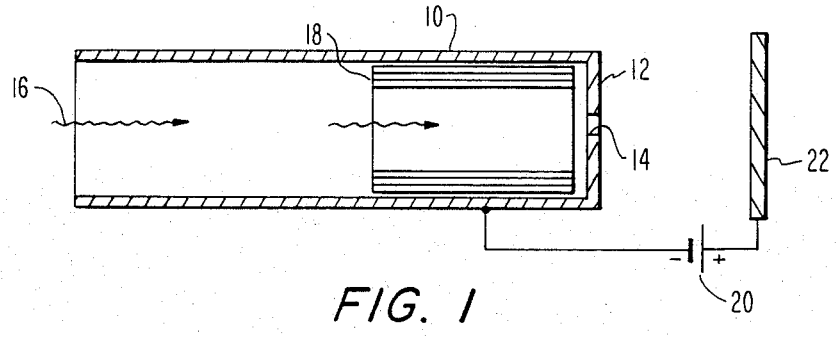
FIG. 1 is a cross sectional view useful to the explanation of basic hollow cathode operation.

FIG. 1 depicts a hollow cathode formed of a tube 10 which usually is cylindrical and which is closed at one end by a plate 12 in which is centrally located an aperture 14. Gas flows through the opposite open end of tube 10 along a path 16. Disposed within tube 10 adjacent to closed end 12 is an insert 18 which may be constructed in several different ways. One is to form it with a porous tungsten that is fabricated by sintering tungsten powder which thereafter is impregnated with an emissive material such as that used for cathodes in vacuum tubes. An alternative is to employ a roll of tantalum foil that has been coated with a similar material. More recently, an uncoated tantalum foil has been used as described in "Experimental Investigation of an Argon Hollow Cathode", *AIAA Paper* No. AIAA-82-1890 for November 1982 by R. P. Stillwell, H. R. Kaufman and R. K. Cupp.

A high temperature is required in order to initiate hollow-cathode operation. That temperature level may be achieved by use of an external heater (not shown) disposed around tube 10. Alternatively, the heat may be supplied by an internal discharge created through use of an additional electrode disposed within tube 10. A direct current power source 20 is connected between tube 10 and a collector 22 spaced beyond aperture 14. When the device is heated to an electron emissive temperature, the potential difference developed by source 20 establishes the existence of electron flow from within tube 10 through aperture 14 to collector 22.

In practice, collector 22 may be the anode of an ion source wherein the electrons are used to generate ions. Alternatively, collector 22 represents an ion beam in an apparatus in which the produced electrons are used to neutralize a beam of energetic ions. Some of the arrangements find use in other apparatus wherein different functions are achieved.

It is important to note that the electron emission is supplied substantially by thermionic emission from the surface of insert 18. Both high-field enhancement of this emission, as well as the contribution of secondary electrons produced from ionization within the hollow cathode, can be significant, but thermionic emission is essential in any event. Chemical reactions at the hot emissive surface of insert 18 take place in the presence of a reactive gas. Those chemical reactions can be controlled by the flow of an inert gas through the interior of tube 10, restricting the use of a reactive gas in the overall apparatus to the volume outside tube 10. Of course, the use of an inert gas in that manner will result in dilution of the reactive gas present externally.

Pressure between 1 and 10 Torr (130–1300 Pascals) typically is used inside a hollow cathode with the internal flow being sufficient to maintain the pressure within that range. The pressure external to the hollow cathode is limited by the pumping capacity of the vacuum chamber in which the cathode is installed in the overall apparatus not shown. Another aspect of hollow cathode operation to be noted is that ions are also present in the gas flowing out of aperture 14. Those ions serve to offset the space charge of the extracted electrons, so that much larger electron currents may be extracted from a hollow cathode than if only electron themselves were present.

The basic elements which pertain to radio frequency diode technology may be understood as to operation by reference to FIG. 2. Disposed within a vacuum chamber 28 are a pair of oppositely-spaced electrodes 30 and 32 across which a radio frequency power source 34 is coupled through a capacitor 36. When a typical applied radio frequency peak-to-peak voltage of between 500 and 1000 volts is applied between electrodes 30 and 32, a glow is generated in the volume 38 between electrode 30 and 32.

One end wall of chamber 28 includes a port 40 for emitting a controlled flow of gas having a known composition. The other end wall of chamber 28 includes a port 42 for bringing the gas pressure within chamber 28 to a value of typically of several tens milliTorr (several Pascals).

The glow created between electrodes 30 and 32 arises by reason of ionization of background atoms or molecules of the gas. Ions so produced, together with electrons created both during ionization and by secondary emission from ions striking the electrons, constitute a plasma. That plasma is at a nearly uniform potential, except near the electrodes where plasma sheaths form.

Because of the presence of capacitor 36, the average net current to each of electrodes 30 and 32 must be zero. That means that the average arrival rate of ions must equal the net arrival rate of electrons at each of the electrodes 30 and 32, that being the net arrival rate of the electrons in order to account for secondarily emitted electrons.

Because the electrons are much lighter than the ions, they move much faster. For sufficient electrons to arrive at an electrode, that electrode must be near to, or positive of, the plasma potential for only a small part of each radio frequency cycle. During the rest of each radio frequency cycle, the electrode is negative of the plasma, so that it can collect ions. To a close approximation, an electrode can be assumed to be negative of the plasma at all times except for once in each radio frequency cycle when it just reaches plasma potential as shown in FIG. 2*a*. Curve 44 represents the radio frequency voltage which results in an average voltage represented by the dashed line 46. With time plotted along the abcissa, and the ordinate representing the electrode voltage relative to the plasma, the plasma voltage is indicated at 48. As shown, the average potential difference between an electrode and the plasma is, thus, approximately one-half the peak-to-peak voltage between the plasma and that electrode.

As described by C. M. Horwitz in "R. F. Sputtering-Voltage Division Between Two Electrodes", Journal of Vacuum Science and Technology A, volume 1, pp.

60–68, January/March 1983, the peak-to-peak and average voltages at an electrode vary in an inverse manner with respect to electrode size. Vacuum chamber 28, if made of a conducting material, is often connected to one of the electrodes, thereby effectively increasing the area of that electrode.

Reactive gases are frequently used in radio frequency diodes. Because the electron generation need not depend on the surface condition of electrodes 30 and 32, operation is not prevented by the presence of a reactive gas as previously indicated. Also as noted, because the temperatures of electrodes 30 and 32 are typically much less than the temperatures of a thermionically emitting cathode, the chemical reaction rates also tend to be much less at the electrode than at the surface of a thermionic cathode.

It also may be noted that, if a symmetrical configuration is used in a radio frequency diode so that both electrodes are of the same size, shape and material, the average and peak-to-peak voltages of both electrodes will be the same. For such a symmetrical configuration, capacitor 36 is not required, because the two average voltages are the same and the two radio frequency voltages are 180° out of phase. Consequently, the plasma outside of the sheath regions near the electrodes or the chamber walls will be at a nearly constant potential. When that condition obtains, there will be small voltages in the plasma arising by reason of the conduction of radio frequency currents, and those currents can produce a large portion, sometimes almost all, of the ionization in the plasma. However, the voltages developed by those currents tend to be much smaller than the voltages across the sheaths at electrodes 30 and 32.

The plasma in such a symmetrical configuration will reach near-equilibrium voltages relative to wall 28 of the vacuum chamber, assuming that that wall is not connected to either electrode. For typical electron temperatures of between one and five electron volts (12,000–60,000 K), the sheath at wall 28 will only have a voltage of about between five and twenty volts. Thus, the use of a symmetrical configuration results in a plasma with small voltage differences, both within the plasma and relative to the wall of vacuum chamber 28. The ions from such a plasma will have a substantial average energy relative to electrodes 30 and 32 and, therefore, will cause a correspondingly large amount of sputtering of the surfaces of those electrodes. The ions that strike the wall of chamber 28, on the other hand, will have very little energy and, therefore, will do little sputtering.

With that background, attention is next directed to FIGS. 3, 4 and 5. In a main body or housing 50 are defined a pair of cavities 52 and 54. A pair of radio frequency electrodes 56 and 58 are individually disposed within respective ones of cavities 52 and 54. Electrodes 56 and 58, individually supported from different screws 60 and 62, are positioned within but insulated from body 50 by respective insulators 64 and 66 through which screws 60 and 62 are threadably inserted. Preferably, there are circumferentially spaced sets of additional screws **60*a* and 62*a*, and insulators 64 and 66**, for mechanical stability. As shown, those additional screws are concealed upon assembly.

Cavities 52 and 54 are separated by a wall 68. Between wall 68 and the respective ones of cavities 52 and 54 are corresponding passages 70 and 72 into which gas enters by way of respective nipples 74 and 76. That gas flows through conduits 78 and 80 into respective ones of cavities 52 and 54, the gas ultimately outletting through apertures 82 and 84 formed through a plate 86. A thicker plate 88 is secured over plate 86 to complete the front wall of housing assembly 50.

A radio frequency power source 90 is coupled to electrodes 56 and 58 through a transformer 92. Source 90 is connected across the primary of transformer 92, while electrodes 56 and 58 are respectively connected across the secondary of transformer 92 by corresponding screws 60 and 62.

Upon initiating operation, a radio frequency discharge is first coupled between electrodes 56 and 58 and main body 50. Electrons and ions escaping through apertures 82 and 84 then permit more direct conduction between cavities 52 and 54 to be established. Passages 70 and 72 must be sufficiently long and narrow to ensure that the preferred conduction path is through apertures 82 and 84 rather than through passages 70 and 72.

With a discharge established externally through an outlet 94 in plate 88, electrons are attracted to an electrode 96 by means of the potential difference imposed by power source 98. Electrode 96 as only schematically shown may be the anode of a discharge chamber when the hollow cathode defined within body 50 is used as an ion source to generate ions. On the other hand, electrode 96 may be equally representative of an ion beam when the radio frequency hollow cathode is employed to neutralize an ion beam. Similarly, for other alternatives, electrode 96 is representative of any other piece of apparatus utilized in a device performing some other overall function.

To appreciate the advantages of the present approach, it will be helpful to note that, after conduction has been established through apertures 82 and 84, there is a symmetrical discharge between electrodes 56 and 58. Except for the plasma sheaths near those electrodes, the plasma within the entire device is only slightly positive relative to main body 50. Thus, the plasma is not sufficiently positive relative to body 50 to cause significant sputtering thereof or of plate 86.

Because the plasma within the device is exposed externally through apertures 82 and 84, electrons can be extracted by an external relative positive potential, as for example that shown on electrode 96. Ions are also present in the efflux from apertures 82 and 84, so that the extracted electron current is enabled to exceed the space-charge-limited value which would be possible if only electrons were present.

Without the extraction of any current through apertures 82 and 84, the plasma is typically between five and twenty volts positive of the potential of body 50, similar to that described above with respect to the radio frequency diode technology. This potential is just sufficient to reduce the escape of electrons to body 50 and plate 86 in accordance with the arrival rate of ions at those components.

When an electron current is extracted through apertures 82 and 84, however, electron arrival rate at main body 50 and plate 86 decreases by a like amount. To reduce the electron arrival rates, the plasma potential must rise relative to the potential on body 50 and plate 86. Because the electron temperature in the plasma is typically only between one and five electron volts, a potential rise of only that amount is sufficient to offset the extraction of most of the electrons that would otherwise go to body 50 and plate 86. Similar to the production of electrons in the radio frequency diode technology with regard to the production of electrons, that production is by ionization of the enclosed gas. This ionization is by the conduction of currents through the gas. Additional ionization is due to collisions by energetic secondary electrons emitted in the process of ions striking the radio frequency electrodes. Consequently, the production of electrons is readily achieved in the presence of a reactive gas.

Operating lifetime is limited primarily by erosion of electrodes 56 and 58. Those electrodes desirably are made of corrosion and sputter resistant materials, permitting the achievment of prolonged lifetime. Moreover, the geometry of the overall device is capable of being such that sputter materials from electrodes 56 and 58 cannot escape through apertures 82 and 84. That is, sputtered atoms travel in straight lines, so the containment of sputter material is essentially solved by the geometry.

In a hollow cathode actually constructed at least generally of a configuration like that shown in FIG. 5, electrodes 56 and 58 were fabricated of stainless steel to have an internal diameter of forty-five millimeters and a depth of twenty-five millimeters. At a frequency of 450 kiloHertz from source 90, a peak-to-peak voltage of 1000 to 1200 volts was required to initiate a discharge. During operation, that peak-to-peak voltage remained near 1000 volts until the discharge was established through apertures 82 and 84. At that point, the peak-to-peak voltage dropped to a value of between 600 and 700 volts for a net radio frequency power of 100 watts delivered to electrodes 56 and 58.

With the diameters of apertures 82 and 84 each being 1.8 millimeters and those apertures spaced apart by three millimeters center-to-center distance and with plate 86 having a thickness of 0.25 millimeters and formed of stainless steel, the potential on electrode 96, when spaced between ten and thirty millimeters from apertures 82 and 84, had to be increased to between 200 and 500 volts in order to initiate discharge through apertures 82 and 84. Except for electrodes 56 and 58 and plate 86, all remaining major parts were constructed of aluminum.

With oxygen gas flow into the hollow cathode assembly of between six and ten standard cubic centimeters per minute, a radio frequency power of one-hundred watts and with electrode 96 carrying a potential between forty and one-hundred volts relative to body 50, an electron current of between fifty and one-hundred-twenty milliamperes could be extracted. The radio frequency current between apertures 82 and 84 was substantially larger than the extracted current, being of the order of four-hundred milliamperes for the conditions above stated.

The configuration is such that no sputtered material from electrodes 56 and 58 can escape through apertures 82 and 84. After a period of operation of eighty hours, no damage could be detected at the apertures, and no maintenance was required before further operation other than removal of some sputter material from the inside of the cavities which had started to peel after exposure to the atmosphere upon disassembly for inspection.

Due to the moderate temperatures, the oxidation rate of aluminum was small. Eventually the oxide coatings on the aluminum parts would need to be removed. This need for maintenance could be eliminated by making these of graphite.

A modification of the foregoing configuration is shown in FIG. 6. In this case, a tube 110, externally closed by a plate 112 having a central orifice 114, is added to the configuration which otherwise is the same as shown in FIG. 5. That modification provides a partially enclosed volume 118 in order to result in an increased pressure external to apertures 82 and 84. Operation of that modification resulted in essentially the same operating characteristics as described above with regard to FIG. 5, but it was found to permit easier starting.

Without the modification of FIG. 6, the potential of the electrode 96 had to be increased to between 200 and 500 volts as mentioned above in order to initiate the discharge through apertures 82 and 84. With the modification of FIG. 6, however, the discharge usually was initiated through apertures 82 and 84 without application of any potential on electrode 96 relative to body 50.

The length of tube 110, formed of stainless steel, was 1.9 centimeters, while its inside diameter was one centimeter. Plate 112, also of stainless steel, was 0.25 millimeter in thickness and aperture 114 had a diameter of six millimeters. As a practical matter, body 50 could be formed as a one-piece structure open only at the front of the cavities across which the very thin plate 86, in which apertures 82 and 84 are formed, is secured. Of course, plate 86 should be demountable for ultimate maintenance upon electrodes 56 and 58 as well as cavities 52 and 54.

One form of device like that of FIG. 5 is shown in FIGS. 3 and 4. It will be observed that, externally, it becomes a rectangular box with outlet 94 formed in plate 88 on one side and the latter sandwiching thin plate 86 in place against body 50. In turn, body 50 is divided in two parts **50*a* and 50*b* respectively defining cavities 52 and 54. Barrier wall 68 in this case takes the form of a stack of three plates, 68*a*, 68*b* and 68*c* disposed between body portions 50*a* and 50*b*. The rear of the cavities is closed by a respective pair of plates 120 and 122 which, as illustrated, include apertures as necessary to accomodate both fasteners and screws and contact screws 60 and 62 as well as nipples 74 and 76. For clarity, many of the fastening parts, and even some of the crucial parts, have been deleted from FIG. 4**. However, the manner of construction of that particular embodiment becomes readily apparent.

In brief summary, a radio frequency hollow cathode has been disclosed which is capable of operating for long periods of time even in a reactive gas environment. Moreover, it is capable of serving as an electron source without significantly encountering the sputter contamination normally associated with prior art using radio frequency electrodes. The arrangement enables the achievement of the heretofore known advantages of hollow cathodes but without the disadvantages encountered before. The approach presented also takes advantage of some technology heretofore known for radio frequency diodes, but that adaptation herein results in a different utility and also avoids difficulties encountered within that field of prior art.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of that which is patentable.

We claim:

1. A cathode assembly comprising:

a housing assembly;

a pair of electrodes mutually spaced apart within and electrically isolated from said assembly;

means for introducing an ionizable gas into the said housing and into the individual vicinity of respective ones of said electrodes;

means for establishing an electrically balanced radio frequency energy discharge between said electrodes to create a plasma exhibiting respective plasma sheaths immediately adjacent to corresponding different ones of said electrodes beyond which sheaths the radio frequency voltages within said plasma, relative to said assembly, are substantially smaller than those within said sheaths;

and means for effecting extraction from said assembly of electrons created within said plasma.

2. A cathode as defined in claim 1 in which said assembly includes means defining a restrictive passage to concentrate radio frequency current through said plasma.

3. A cathode as defined in claim 2 in which said defining means includes means effectively forming a pair of apertures individually communicating with respective different ones of said electrodes and enabling the pressure between said apertures to be substantially different from that existing in the remainder of said plasma.

4. A cathode as defined in claim 3 which includes means for extracting and electrons from a region disposed between said apertures.

5. A cathode comprising:

a housing assembly which defines a pair of cavities;

a pair of radio frequency electrodes individually located within and electrically insulated from respective different ones of said cavities;

means for introducing an ionizable gas individually into respective different ones of said cavities;

means defining a pair of apertures individually outletting from respective different ones of said cavities;

means for supplying radio frequency energy to said electrodes to establish a plasma of said gas;

and means for effecting extraction from said assembly of electrons created within said plasma.

6. A cathode as defined in claim 5 in which said housing assembly includes means defining passages for the introduction of said gas and dimensioned to establish a preferred current conduction path through said apertures.

7. A cathode as defined in claim 5 in which said electrodes are formed and positioned within said cavities relative to communication with said apertures to create a symmetrical discharge between said electrodes primarily having insufficient potential difference relative to said assembly to effect significant sputtering of any portion of said housing assembly.

8. A cathode as defined in claim 5 which includes means extractive of electrons from said apertures in excess of the space-charge-limited value possible in the absence of ions in said plasma.

9. A cathode as defined in claim 5 in which the geometry of said electrodes and said cavities, together with the location of said apertures, is selected to insure against the escape of sputter material through said apertures.

10. A cathode comprising:

a housing assembly which defines a pair of cavities;

a pair of radio frequency electrodes individually located within and electrically insulated from respective different ones of said cavities;

means for introducing an ionizable gas individually into different ones of said cavities;

means defining a pair of apertures individually outletting from respective different ones of said cavities;

means for supplying radio frequency energy to said electrodes to establish a plasma;

a tube surrounding and projecting outwardly of said assembly from said apertures;

a plate closing the outward end of said tube;

and means defining an orifice in said plate sized to create increased pressure immediately beyond said apertures.

11. A cathode comprising:

a housing assembly which defines a pair of cavities;

a pair of radio frequency electrodes individually located within and electrically insulated from respective different ones of said cavities;

means for introducing an ionizable gas individually into different ones of said cavities;

means defining a pair of apertures individually outletting from respective different ones of said cavities;

means for supplying radio frequency energy to said electrodes to establish a plasma;

a pair of spaced-opposed bodies individually defining respective different ones of said cavities;

means defined in said assembly to define passageways respectively leading from said cavities;

means covering one end of each of said cavities and including said means defining said apertures;

and means disposed between said cavities to separate plasma flow from said cavities individually to respective different ones of said apertures.

12. A method of producing electrons which comprises:

introducing an ionizable gas into a cavity;

producing radio frequency energy within said cavity and thereby creating a plasma which includes electrons and ions derived from said gas;

and extracting said derived electrons from said cavity for utilization externally to said cavity.

* * * * *

UNITED STATES PATENT AND TRADEMARK OFFICE

CERTIFICATE OF CORRECTION

PATENT NO. : 4,954,751

DATED : September 4, 1990

INVENTOR(S) : Harold R. Kaufman, et al

It is certified that error appears in the above-identified patent and that said Letters Patent is hereby corrected as shown below:

Column 9, line 29, "and" should be deleted.

Signed and Sealed this

Seventeenth Day of December, 1991

*Attest:*

HARRY F. MANBECK, JR.

*Attesting Officer*

*Commissioner of Patents and Trademarks*